United States Patent [19]

Mudge et al.

[11] Patent Number: 5,030,507

[45] Date of Patent: Jul. 9, 1991

[54] FORMALDEHYDE-FREE NONWOVEN BINDER COMPOSITION

[75] Inventors: Paul Mudge, Belle Mead; Sirisoma Wanigatunga, Bridgewater, both of N.J.

[73] Assignee: National Starch and Chemical Investment Holding Corporation, Wilmington, Del.

[21] Appl. No.: 465,815

[22] Filed: Jan. 12, 1990

[51] Int. Cl.[5] ..... B32B 27/04; D04H 3/00

[52] U.S. Cl. ..... 428/288; 428/290; 524/813

[58] Field of Search ..... 428/288, 290, 245; 524/813

[56] References Cited

U.S. PATENT DOCUMENTS

| | | | |
|---|---|---|---|
| 2,606,892 | 8/1952 | Kropa et al. | 526/312 |
| 3,551,390 | 12/1970 | Krimm et al. | 526/312 |
| 4,070,323 | 1/1978 | Vanderhoff et al. | 524/813 |
| 4,119,746 | 10/1978 | Bleyle | 427/381 |
| 4,291,087 | 9/1981 | Warburton, Jr. | 428/288 |
| 4,406,660 | 9/1983 | Beiner et al. | 604/376 |
| 4,514,552 | 4/1985 | Shay et al. | 526/301 |
| 4,600,761 | 7/1986 | Ruffner et al. | 526/270 |
| 4,608,314 | 8/1986 | Turpin et al. | 428/425.8 |
| 4,659,795 | 4/1987 | Tsutsui et al. | 526/301 |
| 4,694,057 | 9/1987 | Smith et al. | 526/206 |
| 4,754,001 | 6/1988 | Blahak et al. | 525/437 |
| 4,754,011 | 6/1988 | Dexter et al. | 526/310 |

*Primary Examiner*—Jenna Davis
*Assistant Examiner*—Terrel Morris
*Attorney, Agent, or Firm*—Edwin M. Szala; Ellen T. Dec

[57] ABSTRACT

Emulsion binders which do not generate formaldehyde during cure are prepared for use in nonwoven products by using a emulsion copolymer comprising by weight about 100 parts $C_1$–$C_8$ alkyl acrylate or $C_1$–$C_8$ alkyl acrylates in combination with styrene, acrylonitrile, vinyl acetate and combinations thereof, about 1 to 20 parts hydroxyalkyl acrylate or methacrylate, about 2 to 20 parts meta or para isopropenyl-$\alpha,\alpha$-dimenthyl benyl isocyanate and optionally 0.1 to 5 parts of a multifunctional monomer. The binders are useful in the formation of heat resistant flexible products for use in roofing, flooring and filtering materials, as well as for facings and other applications in general purpose nonwoven products.

15 Claims, No Drawings

FORMALDEHYDE-FREE NONWOVEN BINDER COMPOSITION

BACKGROUND OF THE INVENTION

The present invention is directed to emulsion binders that cure to form strong thermosetting bonds, with no formaldehyde generation for use in the formation of nonwoven products. These binders can be broadly classified as general purpose binders and heat resistant binders.

General purpose non-woven products have gained acceptance in the industry for a wide range of applications, particularly as replacements for woven fabrics in constructions such as for facings or topsheets in diapers, incontinent pads, bed pads, sanitary napkins, hospital gowns, and other single and multi-use nonwoven products. For such uses it is desirable to produce a nonwoven product which closely resembles the drape, has flexibility and hand softness of a textile and yet is as strong as possible.

Heat resistant binders are used in the formation of asphalt-like roofing membranes such as those used on flat roofs. Polyester webs or mats about one meter in width are formed, saturated with binder, dried and cured to provide dimensional stability and integrity to the webs, thereby allowing them to be used on site or rolled and transported to a converting operation where one or both sides of the webs are coated with molten asphalt. The binder utilized in these webs plays a number of important roles in this regard. If the binder composition does not have adequate heat resistance, the polyester web will shrink when coated at temperatures of 150°-250° C. with the asphalt. A heat resistant binder is also need for application of the roofing when molten asphalt is again used to form the seams and, later, to prevent the roofing from shrinking when exposed to elevated temperatures over extended periods of time. Such shrinking would result in gaps or exposed areas at the seams where the roofing sheets are joined as well as at the perimeter of the roof.

Since the heat resistant binders used in these structures are present in substantial amounts, i.e., on the order of about 25% by weight, the physical properties thereof must be taken into account when formulating for improved heat resistance. Thus, the binder must be strong enough to withstand the elevated temperatures but must also be flexible at room temperature so that the mat may be rolled or wound without cracking or creating other weaknesses which could lead to leaks during and after impregnation with asphalt.

Conventional binders generate formaldehyde upon curing. Heat resistant binders have traditionally been prepared from acrylate or styrene/acrylate copolymers containing N-methylol functionality which generate formaldehyde. Other techniques for the products of heat resistant roofing materials include those described in U.S. Pat. No. 4,539,254 involving the lamination of a fiberglass scrim to a polyester mat thereby combining the flexibility of the polyester with the heat resistance of the fiberglass. These binders also generate formaldehyde. Conventional general purpose binders include formaldehyde-generating urethane and acrylic polymeric resins. These reins are typically the source of substantial quantities (about 200 to 500 ppm or more in the ambient air) of formaldehyde during curing. Formaldehyde has been identified as a hazardous substance and a great deal of attention has been focused in recent years on a substitute binder free of formaldehyde generation. The current limit on formaldehyde concentration in the workplace is about 3 ppm in the ambient air.

The prior art with regard to non-formaldehyde systems has suggested using binders such as urethane polymers and acrylic polymers, as disclosed in Van Norden Morin, U.S. Pat. No. 2,837,462, Baker, Jr., U.S. Pat. No. 4,207,367, Fulmer et al., U.S. Pat. No. 4,381,332 and others. These alternative systems do not appear to have achieved substantial commercial significance.

A need exists for an improved emulsion binder than can be used in heat resistant applications as well as general purpose applications without generating formaldehyde during cure. The preferred heat resistant binders will provide nonwoven fabrics having high tensile strength and heat resistance without generating formaldehyde. The preferred general purpose binder will provide a nonwoven fabric with high wet tensile strength, moisture and solvent resistance, and tear resistance wihtuot generating formaldehyde.

SUMMARY OF THE INVENTION

In one embodiment, the present invention relates to a process for preparing a general purpose nonwoven product from a loosely assembled mass of fibers comprising the steps of:

a) bonding the fibers with a formaldehyde-free copolymer emulsion binder having a glass transition temperature (Tg) from −50° C. to 50° C., said binder being prepared by the emulsion polymerization of about 100 parts by weight of $C_1$–$C_8$ alkyl acrylate or methacrylate or $C_1$–$C_8$ alkyl acrylate or methacrylate in combination with styrene, acrylonitrile or vinyl acetate, about 1 to 20 parts of hydroxyacrylate or methacrylate, and about 2 to 20 parts of meta or para isopropenyl-α,α-dimethyl benzyl isocyanate and about 0.0–3.0 parts of a multifunctional monomer;

b) removing excess binder and c) drying and curing the mat of bonded fibers.

Another embodiment of the invention relates to a general purpose nonwoven fabric formed from a loosely assembled web of fibers bonded together with a formaldehyde-free copolymer emulsion binder having a glass transition temperature of about −50° C. to about 50° C.; said binder being prepared by the emulsion polymerization of:

a) about 100 parts by weight of $C_1$–$C_8$ alkyl acrylate or methacrylate or alkyl acrylate or methacrylate in combination with styrene, acrylonitrile or vinyl acetate;

b) about 1–20 parts by weight of a hydroxyalkyl acrylate or methacrylate;

c) about 2–20 parts by weight of meta or para isopropenyl-α,α-dimethyl benzyl isocyanate; and d) about 0.0–3.0 parts of a multifunctional monomer.

The present invention also relates to a process for preparing a heat resistant nonwoven product comprising the steps of:

a) impregnating a nonwoven web with a formaldehyde-free copolymer emulsion binder having a glass transition temperature (Tg) of 5° to 50° C., said binder comprising by weight about 100 parts of $C_1$–$C_8$ alkyl acrylate or methacrylate or $C_1$–$C_8$ alkyl acrylate or methacrylate in combination with styrene and/or acrylonitrile monomers, about 1 to 20 parts of hydroxyalkyl acrylate or methacrylate, about 2 to 20 parts of meta or para isopropenyl-α,α-dimethyl benzyl isocyanate and about 0.1 to 3 parts of a multifunctional monomer;

b) removing excess binder; and c) drying and curing the web.

The present intention also relates to a roofing membrane comprising a polyester mat impregnated with a formaldehyde-free copolymer emulsion binder having a glass transition temperature (Tg) of 5° to 50° C., said binder comprising by weight abut 100 parts of $C_1$–$C_8$ alkyl acrylate or methacrylate or $C_1$ to $C_8$ alkyl acrylate or methacrylate in combination with styrene and/or acrylontrile monomers, about 1 to 20 parts of hydroxyalkyl acrylate or methacrylate, about 2 to 20 parts of meta or para isopropenyl-α,α-dimethyl benzyl isocyanate and about 0.1–3 parts of a multi-functional monomer; the impregnated mat being suitable for subsequent coating with asphalt.

DETAILED DESCRIPTION OF THE PREFERRED EMBODIMENTS

The monomers which comprise the major portion of the emulsion copolymer should be selected to have a Tg within the range of −50° to 50° C., preferably about 10° to 30° C. The acrylate or methacrylate esters used in the copolymers described herein are ethylenically unsaturated esters of acrylic or methacrylic acid containing 1 to 8 carbon atoms in the alkyl group including methyl, ethyl, propyl, butyl, hexyl, heptyl and octyl. The correspondent methacrylates may also be used as mixtures of any of the above. The relative proportions of the monomers will vary depending upon the Tg of the specific acrylate or methacrylate employed. Thus relatively soft, low Tg acrylates are used to soften high Tg methacrylates. It will also be recognized that other monomers, such as acrylonitrile, vinyl acetate or styrene, which are sometimes used in emulsion binders, may also be present in conventional amounts and at levels consistent with the desired Tg range.

m-TMI (meta or para isopropenyl-α,α-dimethyl benzyl isocyanate) is a mono-isocyanate which can be commercially obtained from American Cyanamid. The crosslinking amount of m-TMI used may vary from about 2 to about 20 parts and preferably about 4 to about 10 parts per 100 parts of acrylate monomer. Methods for making emulsion copolymers using m-TMI and certain monomers or polymers have been disclosed in U.S. Pat. Nos. 4,754,011 and 4,694,057, which are incorporated herein by reference.

The hydroxy functional monomers utilized herein include the hydroxy $C_2$–$C_4$ alkyl acrylates or methacrylates such as hydroxypropyl, hydroxypropyl and hydroxybutyl acrylate or methacrylate. These monomers are used in amounts of 1 to 20 parts, and preferably 2 to 10 parts by weight.

An olefinic unsaturated acid may be added to the binder composition to improve adhesion to the polyester web and contributes additional heat resistance to the nonwoven product. These acids include the alkenoic acids having from 3 to 6 carbon atoms, such as acrylic acid, methacrylic acid and crotonic acid; the alkenedioic acids, e.g., itaconic acid, maleic acid or fumaric acid or mixtures thereof, in amounts sufficient to provide up to about 4 parts, preferably 0.5 to 2.5 parts, by weight of monomer units per 100 parts of the acrylate monomers.

Additionally, there may be present in the binders of the invention 0.0 to 3 parts by weight, preferably 0.3 to 2.0 parts, of at least one multifunctional monomer. These multifunctional monomers provide some crosslinking and consequent heat resistance to the binder prior to the ultimate curing mechanism. Suitable multifunctional monomers include vinyl crotonate, allyl acrylate, allyl methacrylate, diallyl maleate, divinyl adipate, diallyl adipate, divinyl benzene, diallyl phthalate, ethylene glycol diacrylate, ethylene glycol dimethacrylate, butanediol dimethacrylate, methylene bis-acrylamide, triallyl cyanurate, triallyl isocyanurate, trimethylolpropane triacrylate, etc. with triallyl cyanurate preferred. The amount of the multi-functional monomer required to obtain the desired level of heat resistance will vary within the ranges listed above. In particular, when triallyl cyanurate is employed, superior heat resistance can be obtained at levels as low as about 0.3 to 2.0 parts, preferably about 0.5 parts, while higher amounts of other multi-functional monomers are needed for comparable results.

These binders are prepared using conventional emulsion polymerization procedures. In general, the respective monomers are interpolymerized in an aqueous medium in the presence of a catalyst, and an emulsion stabilizing amount of an anionic or a nonionic surfactant or mixtures thereof. The aqueous system may be maintained by a suitable buffering agent, if necessary, at a pH of 2 to 6. The polymerization is performed at conventional temperatures from about 20° to 60° C., preferably from 38° to 45° C., with sufficient time to achieve a low residual monomer content, e.g. from 1 to about 8 hours, preferably from 3 to about 4 hours. Conventional batch, semi-continuous or continuous polymerization procedures may be employed.

The polymerization is initiated by a water soluble free radical initiator, preferably a water soluble peracid or salt thereof, e.g. hydrogen peroxide, sodium peroxide, lithium peroxide, peracetic acid, persulfuric acid or the ammonium and alkali metal salts thereof, e.g. ammonium persulfate, sodium peracetate, lithium persulfate, potassium persulfate, sodium persulfate, etc. A suitable concentration of the initiator is from 0.05 to 0.30 weight percent and preferably from 0.1 to 1 weight percent.

The free radical initiator can also be used in combination with a suitable reducing agent in a redox couple. The reducing agent is typically an oxidizable sulfur compound such as an alkali metal metabisulfite and pyrosulfite, e.g. sodium metabisulfite, sodium formaldehyde sulfoxylate, potassium metabisulfite, sodium pyrosulfite, etc. The amount of reducing agent which can be employed throughout the copolymerization generally varies from about 0.1 to 3 percent by weight of the amount of polymer.

The polymerization is carried out at a pH of between 2 and 7, preferably between 3 and 5. In order to maintain the pH range, it may be useful to work in the presence of customary buffer systems, for example, in the presence of alkali metal acetates, alkali metal carbonates, alkali metal phosphates. Polymerization regulators, like mercaptans, aldehydes, chloroform, methylene chloride and trichloroethylene, can also be added in some cases.

The dispersing agents are the emulsifiers generally used in emulsion polymerization, as well as optionally protective colloids. It is also possible to use emulsifiers alone or in mixtures with protective colloids.

The emulsifying agent can be any nonionic or anionic surface active agent or mixtures thereof generally employed in emulsion polymerization procedures. When combinations of emulsifying agents are used, it is advantageous to use a relatively hydrophobic emulsifying agent in combination with a relatively hydrophillic agent. The amount of emulsifying agent is generally from about 1 to about 10, preferably from about 2 to about 6, weight percent of the monomers used in the polymerization.

Suitable protective colloids optionally employed are partially or completely saponified polyvinyl alcohol with degrees of hydrolysis between 75 and 100%, and viscosities of between 3 and 48 cps, measured as a 4% aqueous solution at 20° C.; water-soluble cellulose ether derivatives, hydroxyethyl cellulose, hydroxypropyl cellulose, methylcellulose or carboxymethyl cellulose; water-soluble starch ethers; polyacrylic acid or water-soluble polyacrylic acid copolymers with acrylamide and/or alkyl acrylates; poly-N-vinyl compounds of open-chained or cyclic carboxylic acid amides; and mixtures thereof.

The emulsifier used in the polymerization can also be added, in its entirety, to the initial charge in the polymerization zone; or a portion of the emulsifier, e.g. from 90 to 25 percent thereof, can be added continuously or intermittently during polymerization.

The preferred interpolymerization procedure is a modified batch process wherein the major amounts of some or all the monomers and emulsifier are added to the reaction vessel after polymerization has been initiated. In this matter, control over the copolymerization of monomers having widely varied degrees of reactivity can be achieved. It is preferred to add a small portion of the monomers initially and then add the remainder of the major monomers and other monomers intermittently or continuously over the polymerization period which can be from 0.5 to about 10 hours, preferably from about 2 to about 6 hours.

The emulsions are produced and used at relatively high solids contents, e.g. up to about 60%, although they may be diluted with water if desired. The preferred emulsions will contain from about 45 to 55, and most preferably about 50% weight percent solids.

PREPARATION OF HEAT RESISTANT BINDERS

In utilizing the binders of the present invention for use in heat resistant applications the polyester fibers are collected as a web or mat using spun bonded, needle punched, entangled fiber, card and bond or other conventional techniques for nonwoven manufacture. When used for roofing membranes, the resultant mat preferably ranges in weight from 10 grams to 300 grams per square meter, with 100 to 200 grams being more preferred, and 125 to 175 considered optimal. The mat is then soaked in an excess of binder emulsion to insure complete coating of fibers with the excess binder removed under vacuum or pressure of nip/print roll. The polyester mat is then dried and the binder composition cured preferably in an oven at elevated temperatures of at least about 150° C. Alternatively, catalytic curing may be used, such as with an acid catalyst, including mineral acids such as hydrochloric acid; organic acids such as oxalic acid or acid salts such as ammonium chloride, as known in art. The amount of catalyst is generally about 0.5 to 2 parts by weight per 100 parts of the acrylate based polymer.

Other additives commonly used in the production of binders for these nonwoven mats may optionally be used herein. Such additives include ionic crosslinking agents, thermosetting resins, thickeners, flame retardants and the like.

While the discussion above has been primarily directed to polyester mats for uses as roofing membranes, the binders of the invention are equally applicable in the production of other nonwoven products including polyester, felt or rayon mats to be used as a backing for vinyl flooring where the vinyl is applied at high temperatures and under pressure so that some heat resistance in the binder is required. Similarly, cellulosic wood pulp filters for filtering hot liquids and gases require heat resistant binders such as are disclosed herein.

PREPARATION OF GENERAL PURPOSE NONWOVEN BINDERS

The copolymers according to the invention for use in "general purpose" nonwoven products have a glass transition temperature of between −50° to +50° C. They are used to prepare nonwoven fabrics by a variety of methods known in the art which in general involve the impregnation of a loosely assembled web of fibers with the binder latex, followed by moderate heating to dry the web. In the case of the present invention this moderate heating also serves to cure the binder by forming a crosslinked interpolymer.

Additionally, there may also be present in the latex binders other additives conventionally employed in similar binders including defoamers, pigments, catalysts, wetting agents, thickeners, external plasticizers, etc. The choice of materials as well as the amounts employed are well known to those skilled in the art. These materials may be added just before application, if their stability in the dispersion of solution is low, or they may be formulated into the aqueous dispersion of the binder and stored if the stability in aqueous dispersion is high.

The starting fibrous web can be formed by any one of the conventional techniques for depositing or arranging fibers in a web or layer. These techniques include carding, garnetting, air-layering, and the like. Individual webs or thin layers formed by one or more of these techniques can also be lapped or laminated to provide a thicker layer for conversion into a heavier fabric. In general, the fibers extend in a plurality of diverse directions in general alignment with the major place of the fabric, overlapping, intersecting and supporting one another to form an open, porous structure. When reference is made to "cellulose" fibers, those fibers contain predominantly $C_6H_{10}O_5$ groupings. Thus, examples of the fibers to be used in the starting web are the natural cellulose fibers such as wood pulp, and chemically modified celluloses such as regenerated cellulose. Often the fibrous starting web contains at least 50% cellulose fibers, whether they be natural or synthetic, or a combination thereof. Other fibers in the starting web may comprise natural fibers such as wool; artificial fibers such as cellulose acetate; synthetic fibers such as polyamides; i.e., nylon, polyesters, i.e., "Dacron", acrylics, i.e., "Dynel," "Acrilan," "Orlon," polyolefins, i.e., polyethylene, polyvinyl chloride, polyurethane, etc., alone or in combination with one another.

The fibrous starting layer or web suitably weighs from about 5 to 65 grams per square yard and generally weighs about 10 to 40 grams per square yard. This fibrous starting layer, regardless of its method of preparation, is then subjected to at least one of the several types of latex bonding operations to anchor the individual fibers together to form a self-sustaining web. Some of the better-known methods of bonding are overall impregnation, spraying or printing the web with intermittent or continuous straight or wavy lines, or areas of binder extending generally transversely or diagonally across the web and, if desired, along the web.

The amount of binder, calculated on a dry basis, applied to the fibrous starting web suitably ranges from about 10 to about 100 parts or more, per 100 parts of the starting web, and preferably from about 20 to about 45 parts per 100 parts of the starting web. The impregnated web is then dried and cured. Thus, the fabrics are suitably dried by passing them through an oven or over a series of heated cans or the like and then through a curing oven or sections of hot cans.

Ordinarily, convection air drying is effected at 65°-95° C. for 2-6 minutes, followed by curing at 145°-155° C. for 1-5 minutes or more. However, other time-temperature relationships can be employed, as are well known in the art, shorter times at higher temperatures or longer times at lower temperatures can be used. For example, the curing step can be carried out at about 135° C. for about 15 minutes or more in a laboratory or pilot line, but may require only 2 to 20 seconds on high pressure high efficiency steam cans used in high speed production. If desired, the drying and curing can be effected in a single exposure or step.

The following examples are given to illustrate the present invention, but it will be understood that they are intended to be illustrative only and not limitative of the invention. In the examples, all parts are by weight and all temperatures in degrees Celsius unless otherwise noted.

EXAMPLE I

The following example describes a method for the preparation of the latex binders that do not generate formaldehyde.

A mixture containing 800 g of water, 2.0 g Aerosol A102 (a surfactant), 5.0 g Triton X-405 (a surfactant), 0.6 g sodium acetate, and 0.4 g sodium formaldehyde sulfoxylate, was prepared. The pH was adjusted to 3.4-4.0, and was charged into a 2 liter, four neck flask. The charge was purged with nitrogen and stirring started. After 10 minutes a mixture of 25 g of ethyl acrylate monomer and 0.2 g TBHP.

The contents were heated to 40° to 45° C. After polymerization started, an emulsified monomers mix containing the following was slowly added over a period of 4½ hrs. This emulsified monomer mix consisted of 120 g water, 15.0 g of AER A102, 120 g of Alipal EP120, 50 g of aqueous solution of m-TMI, 25 g of hydroxypropyl methacrylate, 5.0 g of triallyl cyanurate, 550 g ethyl acrylate and 400 g methyl methacrylate. Also slowly added over a period of 5 hours were initiator solutes of 4.0 g sodium formaldehyde sulfoxylate and 4.8 g tert-butyl hydroperoxide, each in 60.0 g of water, with the reaction temperature being maintained at 40°-45° C. At the end of the addition, the reaction was held 15 minutes at 40°-45° C., then 1.2 g of t-butyl hydroperoxide and 1.0 g sodium formaldehyde sulfoxylate, each in 15 g of water, was added to reduce residual monomer, if any.

The latex was then cooled and filtered. It had the following typical properties: 48.7% solids, pH 4.2, and 252 cps viscosity.

The resultant binder, designated in Table I as Emulsion 10, had a composition of 60 parts ethyl acrylate, 40 parts methyl methacrylate, 10 parts m-TMI, 5.0 parts hydroxypropyl methacrylate, and 0.5 part triallyl cyanurate (60 EA/40 MMA/10 m-TMI/5 HPMA/0.5 TAC).

Using a similar procedure other emulsions in Table I were prepared.

TABLE I

| Sample Tested | EA:MMA | Composition m-TMI | HEA | HPMA | TAC | Peak Load lb. | Tested at 180° % Elong @ 5 lb Load % | % Eong @ 2 lb load % |
|---|---|---|---|---|---|---|---|---|
| 1. | 60:40 | 4.0 | — | 0.8 | 0.5 | 15.2 | 35.6 | 4.0 |
| 2. | " | 4.0 | — | 1.5 | 0.5 | 19.7 | 32.2 | 3.8 |
| 3. | " | 4.0 | — | 3.0 | 0.5 | 15.6 | 35.9 | 4.9 |
| 4. | " | 8.0 | — | 3.0 | 0.5 | 16.4 | 32.8 | 3.1 |
| 5. | " | 8.0 | — | 3.0 | 0.8 | 19.8 | 29.4 | 5.6 |
| 6. | " | 10.0 | — | 2.5 | 0.5 | 18.6 | 38.2 | 18.2 |
| 7. | " | 10.0 | — | 5.0 | 0.5 | 22.4 | 32.9 | 7.2 |
| 8. | " | 10.0 | — | 5.0 | 0.75 | 20.7 | 30.9 | 3.9 |
| 9. | " | 10.0 | — | 5.0 | 1.0 | 21.5 | 30.7 | 4.4 |
| 10. | " | 10.0 | — | 5.0 | 1.5 | 19.0 | 31.0 | 3.7 |
| 11. | " | 10.0 | — | 10.0 | 0.5 | 23.2 | 26.7 | 4.3 |
| 12. | " | 10.0 | — | 12.5 | 0.5 | 20.9 | 34.7 | 15.8 |
| Control | " | 5.2 NMA | 2 MMA | | 0.5 | 18.2 | 13.9 | 3.1 |

In testing the binders prepared herein, a polyester spunbonded, needle punched mat was saturated in a low solids (10-30%) emulsion bath. Excess emulsion was removed by passing the saturated mat through nip rolls to give samples containing 25% binder based on the weight of the polyester. The saturated mat was dried on a canvas covered drier, then cured in a force air oven for 10 minutes at a temperature of 150° C. Strips were then cut 2.54 cm by 12.7 cm in machine direction. Tensile values were measured on an Instron tensile tester Model 1130 equipped with an environmental chamber at crosshead speed 10 cm/min. The gauge length at the start of each test was 7.5 cm.

In order to evaluate the heat resistance of the binders prepared herein, a Thermomechanical Analyzer was employed to show a correlation between conventional tensile and elongation evaluations.

The Thermomechanical Analyzer measures dimensional changes in a sample as a function of temperature. In general, the heat resistance is measured by physical dimensional changes of a polymer film as a function of temperature which is then recorded in a charge with temperature along the absicissa and change in linear dimension as the ordinate. Higher dimensional change in the samples represents lower heat resistance. The initial inflection is interpreted as the thermomechanical glass transition temperature (Tg) of the polymer. Samples were prepared for testing on the analyzer by casting films of the binders on Teflon coated metal plates with a 20 mil. applicator.

Binders were tested against a control which is a formaldehyde generating binder based on n-methylol acrylamide monomer containing crosslinking system. This control has been discussed in a commonly assigned copending U.S. patent application Ser. No. 07,109,651, filed 10/16/87 by Pangrazi et al. It can be seen that certain compositions, (eg, 2,4, and 10) performed comparable to the control.

EXAMPLE II

Using the same procedure as described in Example I, other emulsions were prepared using hydroxy ethyl acrylate (HEA) instead of HPMA and 100 parts of 60/40 ethyl acrylate/methyl methacrylate. The testing procedures were the same as in Example I. See Table II for the test results.

TABLE II

| Sample Tested | EA:MMA | Composition m-TMI | HEA | HPMA | TAC | Peak Load lb. | Tested at 180° % Elong @ 5 lb Load % | % Elong @ 2 lb load % |
|---|---|---|---|---|---|---|---|---|
| 13. | 60:40 | 4.0 | — | — | 0.5 | 19.6 | 37.2 | 11.1 |
| 14. | 60:40 | 4.0 | 1.0 | — | 0.5 | 17.4 | 27.8 | 3.3 |
| 15. | 60:40 | 4.0 | 2.0 | — | 0.5 | 20.1 | 33.1 | 11.4 |
| 16. | 60:40 | 8.0 | 6.0 | — | 0.5 | 20.6 | 27.7 | 4.9 |
| Control | 60:40 | 5.2 NMA | 2 MAA | | 0.5 | 18.2 | 13.9 | 3.1 |

It can be seen that certain compositions (for example 14 and 16) had comparable performance to the formaldehyde generating control.

EXAMPLE III

Using the same procedure as described in Example I the following emulsions were prepared as binders for pulp and polyester based general purpose nonwovens.

| Emulsion | Composition |
|---|---|
| 17. | 70 EA/30 MMA/4 m-TMI/2 HEA |
| 18. | 70 EA/30 MMA/8 m-TMI/4 HEA |
| 19. | 70 VA/30 BA/4 m-TMI/2 HEA |
| 20. | 70 VA/30 BA/8 m-TMI/4 HEA |
| 21. | 60 EA/40 MMA/8 m-TMI/4 HEA/0.5 TAC |
| Control | 75 VA/25 BA/3.6 NMA |

In preparing samples for testing general purpose nonwoven products, lengths of 15 gram per square yard polyester were saturated using a Butterworth Padder and a bath of 100 parts dry binder, 2 parts surfactant, and sufficient water to give a 25% solids dilution, with a dry pick up of approximately 40 to 45 parts binder per 100 parts polyester web. The saturated web was dried for 2 minutes at 145° C. in a laboratory contact drier.

The tensile tests were run on a standard Instron tester set at 3 inch guage length and 5 inch crosshead speed. The wet tensile test was run after soaking specimens one minutes in a 0.5% solution of Aerosol OT wetting agent. Results shown reflect the average of 10 tests.

The hand softness of a nonwoven is difficult to test using quantitative techniques. There is a correlation between softness of the nonwoven and Tg of the binder system, however since Tg is the temperature at which the polymer changes from a glassy to a rubbery state (which for soft nonwoven binder is generally in the range of −20° C. to −35° C. or lower), neither measured Tg nor calculated Tg is a completely adequate measure of the perceived softness of a binder at ambient conditions. Nonetheless, for binders using the same class of comonomers for example, vinyl acrylic binders, ethylene-vinyl acetate binders, etc, the lower the Tg of the copolymer, the greater the softness of the nonwoven product treated with the binder.

In the case of the nonwoven samples tested herein, a panel test was also run to determine the relative softness by rating the samples in order of softest to firmest by feeling the drape and pliability of the samples. The softness sample was rated as 1, the next as 2, etc., for the total numbers tested. The results reported show the average of five panelist ratings for each sample.

Tables III and IV show data obtained on pulp and polyester nonwovens respectively.

TABLE III

TENSILE RESULTS ON PULP NONWOVENS

| Composition Tested | % Pick Up | Basis Weight gsy | Dry Peak Load | Dry Elong % | Wet Peak Load | Wet Elong % | M.E.K. Peak Load | MEK Elong % |
|---|---|---|---|---|---|---|---|---|
| 17 | 13.3 | 37.2 | 5.27 | 5.9 | 1.09 | 9.9 | 0.72 | 2.7 |
| 18 | 13.7 | 37.1 | 5.03 | 5.6 | 0.77 | 8.1 | 0.56 | 1.9 |
| 19 | 13.1 | 36.7 | 4.51 | 4.6 | 0.81 | 9.3 | 0.49 | 2.4 |
| 20 | 13.6 | 37.4 | 5.39 | 4.7 | 0.94 | 9.1 | 0.59 | 2.1 |
| 21 | 12.9 | 36.7 | 6.16 | 3.1 | 0.71 | 5.3 | 0.54 | 1.3 |
| Control | 13.9 | 37.4 | 6.04 | 5.8 | 2.64 | 12.1 | 1.61 | 4.1 |

TABLE IV

TENSILE RESULTS ON POLYESTER NONWOVENS

| Composition Tested | % Pick Up | Basis Weight gsy | Dry Peak Load | Dry Elong % | Wet Peak Load | Wet Elong % | M.E.K. Peak Load | Hand (1 = soft) (7 = Hard) |
|---|---|---|---|---|---|---|---|---|
| 17 | 42.8 | 25.2 | 1.49 | 37.7 | 0.57 | 8.9 | 0.08 | 2 |
| 18 | 43.4 | 25.8 | 1.71 | 26.3 | 0.54 | 5.5 | 0.05 | 3 |
| 19 | 40.2 | 25.6 | 1.51 | 20.7 | 0.98 | 28.7 | 0.06 | 4 |
| 20 | 45.8 | 23.3 | 2.24 | 24.1 | 1.08 | 22.5 | 0.06 | 5 |

TABLE IV-continued

| TENSILE RESULTS ON POLYESTER NONWOVENS | | | | | | | | |
|---|---|---|---|---|---|---|---|---|
| Composition Tested | % Pick Up | Basis Weight gsy | Dry Peak Load | Dry Elong % | Wet Peak Load | Wet Elong % | M.E.K. Peak Load | Hand (1 = soft) (7 = Hard) |
| Control | 43.5 | 22.1 | 2.34 | 23.1 | 1.47 | 22.1 | 0.37 | 5 |

It can be seen from the results in Tables III and IV that the formaldehyde free m-TMI containing composition performed comparable to the formaldehyde producing control composition.

It will be apparent that various changes and modifications may be made in the embodiments of the invention described above, without departing from the scope of the invention, as defined in the appended claims, and it is intended therefore, that all matter obtained in the foregoing description shall be interpreted as illustrative only and not as limitative of the invention.

We claim:

1. A nonwoven fabric formed from a loosely assembled web of fibers bonded together with a copolymer emulsion binder having a glass transition temperature of −50° C. to +50° C.; said binder being prepared by the emulsion polymerization of:

a) about 100 parts by weight of $C_1$–$C_8$ alkyl acrylate or methacrylate or $C_1$–$C_8$ alkyl acrylate or methacrylate and a monomer selected from the group consisting of styrene, acrylonitrile and vinyl acetate;

b) about 1 to 20 parts by weight of a hydroxyalkyl acrylate or methacrylate;

c) about 2 to 20 parts by weight of meta or para isopropenyl-α,α-dimethyl benzyl isocyanate and d) about 0.0–3.0 parts of a multi-functional monomer.

2. The nonwoven fabric according to claim 1, comprising a loosely assembled web of hydrophobic fibers for use as a facing in disposable constructions.

3. The nonwoven fabric according to claim 1, wherein the bonding agent is present in an amount of 20 to 45 parts dry weight per 100 parts of fiber.

4. The nonwoven fabric according to claim 1, wherein said hydroxyalkyl acrylate is selected from the group consisting of $C_2$–$C_4$ hydroxyalkyl acrylates and methacrylates.

5. The nonwoven fabric according to claim 1, wherein said binder additionally contains a multifunctional monomer, selected from the group consisting of triallyl cyanurate, triallyl isocyanurate, vinyl crotonate, allyl acrylate, allyl methacrylate, diallyl maleate, divinyl adipate, diallyl adipate, divinyl benzene, diallyl phthalate, ethylene glycol diacrylate, ethylene glycol dimethacrylate, butanediol dimethacrylate, methylene bis-acrylamide, and trimethylolpropane triacrylate.

6. The nonwoven fabric according to claim 1, wherein said binder additionally contains an unsaturated alkenoic or alkenedionic acid having 3 to 6 carbon atoms.

7. The nonwoven fabric according to claim 1, wherein said binder comprises by weight, 70 parts ethyl acrylate, 30 parts methyl methacrylate, 4 parts meta or para isopropenyl-α,α-dimethyl benzyl isocyanate and 2 parts hydroxy ethyl acrylate.

8. The nonwoven fabric according to claim 1, wherein said binder comprises by weight, about 70 parts vinyl acetate, about 30 parts butyl acrylate, about 8 parts meta or para isopropenyl-α,α-dimethyl benzyl isocyanate, and about 2 parts hydroxy ethyl acrylate.

9. The nonwoven fabric according to claim 7, wherein said binder comprises by weight, about 60 parts ethyl acrylate, about 40 parts methyl methacrylate, 4 parts hydroxy acrylate, about 8 parts meta or para isopropenyl-α,α-dimethyl benzyl isocyanate, and about 0.5 parts triallyl cyanurate.

10. A roofing membrane comprising a polyester mat impregnated with a copolymer emulsion binder having a glass transition temperature (Tg) of 5° to 50° C., the binder comprising:

a) about 100 parts by weight of $C_1$–$C_8$ alkyl acrylate or methacrylate or $C_1$–$C_8$ alkyl acrylate or methacrylate and a monomer selected from the group consisting of styrene and acrylonitrile;

b) about 1 to 20 parts by weight of hydroxyalkyl acrylate or methacrylate;

c) about 2 to 20 parts by weight of meta or para isopropenyl-α,α-dimethyl benzyl isocyanate; and d) about 0.1 to 5 parts of a multifunctional monomer; the impregnated mat being subsequently coated with asphalt.

11. The roofing membrane according to claim 10, wherein said multifunctional monomer is selected from the group consisting of triallyl cyanurate, triallyl isocyanurate, vinyl crotonate, allyl acrylate, allyl methacrylate, diallyl maleate, divinyl adipate, diallyl adipate, divinyl benzene, diallyl phthalate, ethylene glycol diacrylate, ethylene glycol dimethacrylate, butanediol dimethacrylate, methylene bis-acrylamide, trimethylolpropane triacrylate.

12. The roofing membrane according to claim 10, additionally containing up to 4 parts by weight of an alkenoic or alkenedioic acid having from 3 to 6 carbon atoms.

13. The roofing membrane according to claim 10, wherein said binder comprises by weight about 60 parts ethyl acrylate, about 40 parts methyl methacrylate, about 10 parts of meta or para isopropenyl-α,α-dimethyl benzyl isocyanate, about 5 parts hydroxypropyl methacrylate and about 0.5 parts triallyl cyanurate.

14. The roofing membrane according to claim 10, wherein said binder comprises by weight about 60 parts ethyl acrylate, about 40 parts methyl methacrylate, about 4 parts meta or para isopropenyl-α,α-dimethyl benzyl isocyanate, about 2 parts hydroxy ethyl acrylate and about 0.5 parts triallyl cyanurate.

15. The roofing membrane according to claim 10, wherein said binder comprises by weight about 60 parts ethyl acrylate, about 40 parts methyl methacrylate, about 4 parts meta or para isopropenyl-α,α-dimethyl benzyl isocyanate, about 3 parts glycidyl methacrylate and about 0.5 parts triallyl cyanurate.

* * * * *